US005211776A

United States Patent [19]

Weiman

[11] Patent Number: 5,211,776

[45] Date of Patent: May 18, 1993

[54] FABRICATION OF METAL AND CERAMIC MATRIX COMPOSITES

[75] Inventor: Sam M. Weiman, Cypress, Calif.

[73] Assignee: General Dynamics Corp., Air Defense Systems Division, Pomona, Calif.

[21] Appl. No.: 380,575

[22] Filed: Jul. 17, 1989

[51] Int. Cl.[5] ..... B05D 1/10; B05D 1/34

[52] U.S. Cl. ..... 148/525; 148/537; 427/456

[58] Field of Search ..... 148/11.5 Q, 2, 3, 525, 148/537; 164/46; 427/34; 29/527.5; 428/614

[56] References Cited

U.S. PATENT DOCUMENTS

| | | | |
|---|---|---|---|
| 3,427,185 | 2/1969 | Cheatham et al. | 427/34 |
| 3,536,953 | 9/1970 | Levinstein . | |
| 3,575,783 | 4/1971 | Kreider | 427/34 |
| 3,596,344 | 8/1971 | Kreider | 427/34 |
| 3,606,667 | 9/1971 | Kreider | 427/34 |
| 3,615,277 | 10/1971 | Kreider et al. . | |
| 3,691,623 | 9/1972 | Staudhammer et al. | 428/614 |
| 3,717,443 | 2/1973 | McMurray et al. | 428/614 |
| 3,734,762 | 5/1973 | Hackman et al. | 164/46 |
| 3,741,796 | 6/1973 | Walker . | |
| 3,826,172 | 7/1974 | Dawson . | |
| 3,840,350 | 10/1974 | Tucker, Jr. . | |
| 3,888,661 | 6/1975 | Levitt et al. . | |
| 3,889,348 | 6/1975 | Lemelson | 29/527.5 |
| 4,134,759 | 1/1979 | Yajima et al. | 428/614 |
| 4,141,802 | 2/1979 | Duparque et al. . | |
| 4,265,982 | 5/1981 | McCreary et al. . | |
| 4,338,380 | 7/1982 | Erickson et al. . | |
| 4,411,935 | 10/1983 | Andersqn . | |
| 4,447,466 | 5/1984 | Jackson et al. . | |
| 4,529,615 | 7/1985 | Zverina et al. . | |
| 4,530,884 | 7/1985 | Erickson et al. . | |
| 4,594,106 | 6/1986 | Tanaka et al. . | |
| 4,595,637 | 6/1986 | Eaton et al. . | |
| 4,627,896 | 12/1986 | Nazmy et al. . | |
| 4,649,060 | 3/1987 | Ishikawa et al. . | |
| 4,659,593 | 4/1987 | Rocher et al. | 29/527.5 |
| 4,769,195 | 9/1988 | Ishikawa et al. | 427/34 |
| 4,775,547 | 10/1988 | Siemers | 427/34 |
| 4,816,347 | 3/1989 | Rosenthal et al. | 428/614 |
| 4,853,294 | 8/1989 | Everett et al. | 428/614 |
| 4,867,644 | 9/1989 | Wright et al. | 428/614 |
| 4,919,594 | 4/1990 | Wright et al. | 29/527.5 |
| 4,978,585 | 12/1990 | Ritter et al. | 428/614 |
| 5,045,407 | 9/1991 | Ritter | 427/34 |

FOREIGN PATENT DOCUMENTS

| | | | |
|---|---|---|---|
| 154814 | 9/1985 | European Pat. Off. | 427/34 |
| 3844290 | 12/1989 | Fed. Rep. of Germany | 427/34 |
| 57-74115 | 5/1982 | Japan | 164/46 |
| 57-74117 | 5/1982 | Japan | 164/46 |
| 60-184652 | 9/1985 | Japan | 427/34 |
| 60-208467 | 10/1985 | Japan | 427/34 |
| 61-87860 | 5/1986 | Japan | 427/34 |
| 2-70369 | 3/1990 | Japan | 164/46 |
| 8301751 | 5/1983 | World Int. Prop. O. | 427/34 |

*Primary Examiner*—George Wyszomierski
*Attorney, Agent, or Firm*—Leo R. Carroll; Henry Bissell

[57] ABSTRACT

A process for manufacturing metal and ceramic matrix composite materials. The invention also encompasses various composite products made by the disclosed method. The resulting composite material comprises a reinforcement material in either continuous or discrete form embedded in a matrix material which is either a pure metal, a metal alloy, or a ceramic. The reinforcing material is optionally coated with a barrier coating material. An electric arc or plasma arc is used to spray a thin layer of matrix material over a preplaced layer of reinforcement material. Successive layers are built up until a desired object shape and thickness are achieved. There is an optional final step of high-temperature diffusion annealing or hot isostatic pressing.

28 Claims, 1 Drawing Sheet

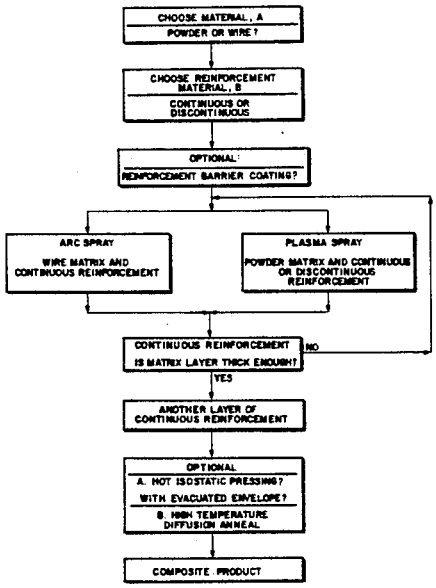

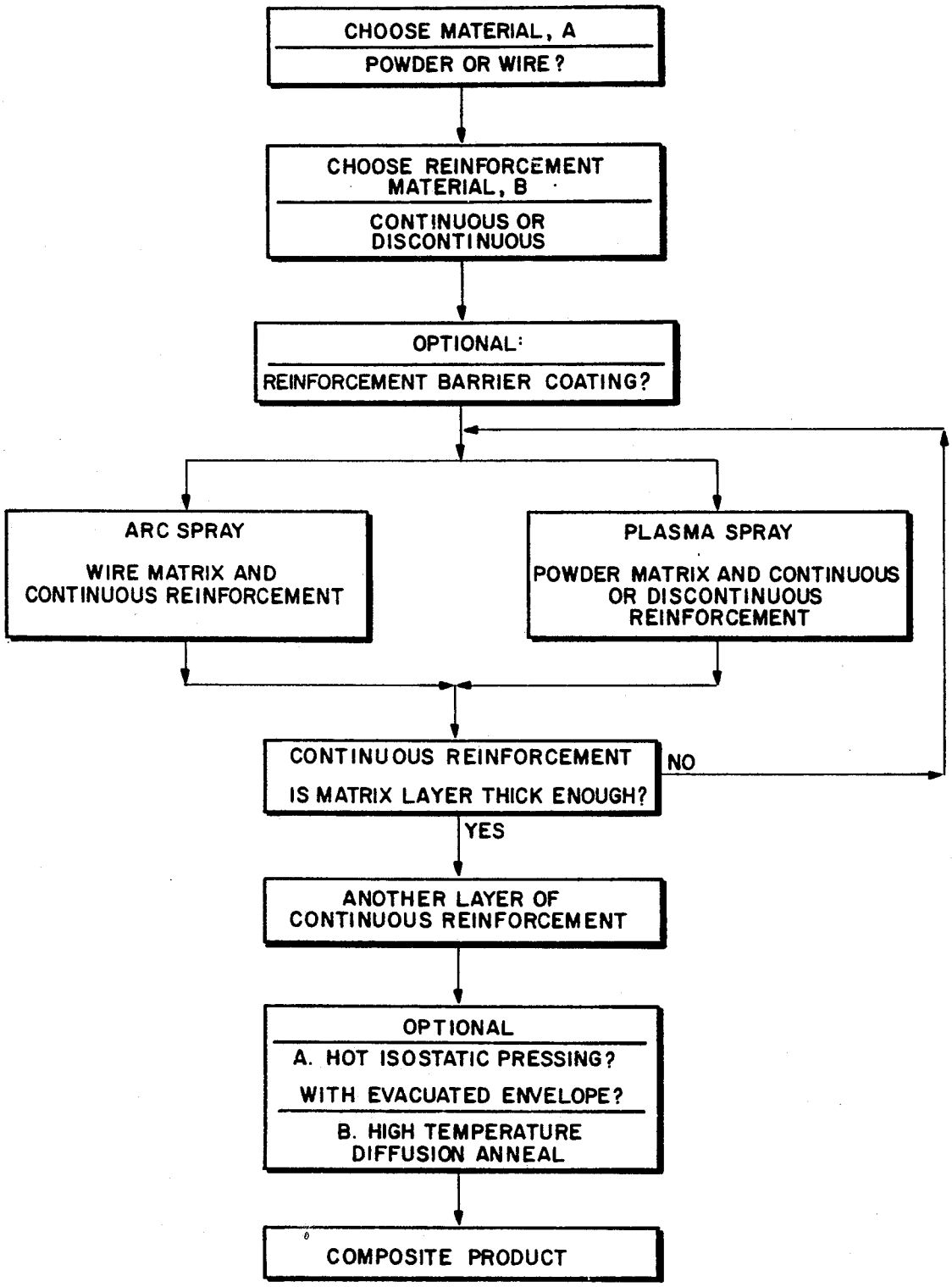
CHOOSE MATERIAL, A
POWDER OR WIRE?
CHOOSE REINFORCEMENT MATERIAL, B
CONTINUOUS OR DISCONTINUOUS
OPTIONAL:
REINFORCEMENT BARRIER COATING?
ARC SPRAY
WIRE MATRIX AND CONTINUOUS REINFORCEMENT
PLASMA SPRAY
POWDER MATRIX AND CONTINUOUS OR DISCONTINUOUS REINFORCEMENT
CONTINUOUS REINFORCEMENT
IS MATRIX LAYER THICK ENOUGH?
NO
YES
ANOTHER LAYER OF CONTINUOUS REINFORCEMENT
OPTIONAL
A. HOT ISOSTATIC PRESSING?
WITH EVACUATED ENVELOPE?
B. HIGH TEMPERATURE DIFFUSION ANNEAL
COMPOSITE PRODUCT

FABRICATION OF METAL AND CERAMIC MATRIX COMPOSITES

BACKGROUND OF THE INVENTION

1. Field of the Invention

This invention relates to methods of manufacturing metal and ceramic matrix composite materials and, more particularly, to methods of manufacturing metal and ceramic composites utilizing thermal spray techniques and an optional finishing step of diffusion annealing and/or hot isostatic pressing.

2. Description of the Related Art

Components for the aircraft and aerospace industries require materials having maximum specific strength and specific modulus. Specific strength is the ratio of tensile strength to density, and specific modulus is the ratio of modulus of elasticity to density. These quantities present the structural properties in terms of what used to be called the strength-to-weight ratio.

Composite structures offer significant weight economy to the engineer when used in structural designs. A composite structure consists of a continuous-phase matrix material which is made stronger and/or stiffer by a second material having a substantially higher tensile strength and/or modulus of elasticity. The material used for reinforcing the matrix can be in the form of fibers, woven textiles, or particles.

A simplified version of the theory behind the reinforcement effect of adding the high-strength/stiffness second-phase material is that the major portion of an applied load is borne by the second-phase material, while the matrix material serves to maintain the geometric and alignment relationships of individual second-phase reinforcing material elements with respect to each other for the case of continuous reinforcement. The matrix provides some degree of ductility and toughness to the composite body by transferring and distributing strain in local areas of the continuous reinforcing phase more widely to other second-phase elements and generally acts as a "glue" to hold the composite assembly together as well as to provide a feasible method of manufacturing a specific shape. The direct utilization of the reinforcing phase as a monolithic body is generally not possible because of extreme brittleness or because of difficulty or expense in obtaining it as a monolithic body. The desired strength/stiffness property of the reinforcing phase is only found in the form of structural units having very small dimensions, generally less than 0.010 inch in the smallest dimension.

In another composite form, the reinforcing phase material may be present in discrete form such as relatively short fibers of glass or silicon carbide whiskers, or short lengths of glass, carbon, graphite, partially crystallized carbon, boron or silicon carbide. These composites depend for their strength upon a degree of particle hardening. Such materials include "cermets," which are a mixture of metal and ceramic substances generally compounded with the object of producing a combination of hardness and toughness such as would be required in a tool material. Another related group of composite materials relies upon dispersion hardening, in which the movement of microscopic dislocations is impeded by strong particles having microscopic dimensions also.

If a composite material contains discrete reinforcing elements, these suffer elastic strains when the material is stressed. These elements contribute in this way to the load-carrying capacity of the material and provide obstacles to the movement of dislocations, assuming that the elements themselves are strong. If the volume of such strong elements in the composite is proportionately large, they will provide a high strength and a corresponding high load carrying capacity. One of the best ways of increasing tensile strength is by using elements in the form of long continuous fibers. The matrix material may begin to flow when stressed but in doing so will cause a force to be set up at the surface of the fiber. If the fiber is sufficiently long, the transmitted force will finally lead to its fracture and the fiber will have fully contributed to the strength of the composite material. Obviously the strength will have a maximum value parallel to the direction of the fibers.

The nature of the interface between the discrete elements and the matrix influences the extent to which the load is transferred from the matrix to the reinforcing material. Cohesion at the interface may be achieved by one of several methods:

(1) Mechanical bonding; this involves a large enough coefficient of friction acting between the surfaces.

(2) Physical bonding, which depends upon van der Waals forces acting between surface molecules.

(3) Chemical reaction bonding at the interface; this, however, may give rise to weak, brittle compounds in some cases.

(4) Bonds formed by solid-solution and diffusion effects.

Organic thermoplastic and thermosetting resin matrix composites have been in use for a long time and their fabrication methods are fully described in the technical literature. Structural metal matrix composites are relatively new and thus far only aluminum and, to a lesser extent, magnesium and copper have achieved reasonable degrees of development. Composites of these metals are obtained through powder metallurgy, liquid metal infiltration, and the diffusion bonding of alternate layers of metal foils and filaments. Ceramic matrix composites are most commonly fabricated by cold press and sinter, cast and sinter, or hot press techniques. All of the above fabrication methods suffer in varying degrees from one or more of the following problems: the presence of internal defects such as voids and incomplete diffusion bonds; the breakup of continuous filaments due to the measurable deformation of the matrix in pressing type operations; excessive reaction between the matrix and the reinforcing phase material; low bond strength between the matrix and the reinforcing phase; and very high cost.

Some examples of the art related to the fabrication of composite materials are given below.

U.S. Pat. No. 3,615,277 to Kreider et al is directed to a process of fabricating a multilayer fiber-reinforced metal matrix composite by winding a filament on a spring-loaded mandrel covered with brazing foil, preheating the mandrel, plasma arc spraying metal matrix material in coalescent form onto the filament windings so as to form a monolayer tape, and low-pressure braze bonding a plurality of tapes together in layers.

U.S. Pat. No. 3,741,796 to Walker is directed to the use of a plurality of torch flames, each resulting from the combustion of gaseous silicon tetrachloride and a mixture of hydrogen and oxygen directed upon a graphite mandrel to form a high-purity silica article upon the mandrel.

U.S. Pat. No. 3,840,350 to Tucker, Jr., is directed to a filament-reinforced composite metallic material which can be fabricated into various size filament-reinforced composite sheets or strips. A process is disclosed in which the metallic matrix of the composite consists of at least two plasma-sprayed particulated discrete metallic components which when subjected to a pressurized heat treatment will react to form a substantially homogenous alloy matrix for the filaments.

U.S. Pat. No. 3,888,661 to Levitt et al is directed to the preparation of a graphite fiber reinforced, metal matrix composite by hot-pressing. The composite comprises layers of a matrix metal selected from the group consisting of magnesium and magnesium based alloys in combination with alternate layers of a graphite fiber. Small additions of a metal selected from the group consisting of titanium, chromium, nickel, zirconium, hafnium, and silicon are made in order to promote wetting and bonding between the graphite fibers and the matrix metal.

U.S. Pat. No. 4,141,802 to Duparque et al is directed to an improvement in fabricating composite panels comprising a metal support foil to which a fiber-reinforced metal matrix layer adheres. The improvement is to interpose a thin layer of a bonding metal or alloy between the support foil and the fiber-reinforced metal matrix layer. The bonding metal layer serves to improve the adhesion of the metal matrix to the support foil and enables the metal matrix layer to be produced under less severe conditions.

U.S. Pat. No. 4,265,982 to McCreary et al is directed to a process of coating woven materials with metals or with pyrolytic carbon by chemical vapor deposition reactions using a fluidized bed. The porosity of the woven material is retained and the tiny filaments which make up the strands which are woven (including inner as well as outer filaments) are substantially uniformly coated.

U.S. Pat. No. 4,447,466 to Jackson et al is directed to a method of fabricating gas turbine engine, superalloy airfoils and other components by a method which uses low-pressure/high-velocity plasma spray-casting and segmented mandrels.

U.S. Pat. No. 4,594,106 to Tanaka et al is directed to flame spraying compositions exhibiting improved adherence to a variety of substrates, as well as articles coated with such compositions. The spraying compositions comprise a granulated mixture of two components: (1) a powdery material selected from the group consisting of powdered metals, heat resistant ceramics, cermets, and resins; and (2) a ceramic needle fiber such as whisker crystals of SiC or $Si_3N_4$. Articles coated with thin films of these coatings exhibit thermal and corrosion resistance.

U.S. Pat. No. 4,595,637 to Eaton et al is directed to a process for plasma spraying small metal fibers onto the surface of a workpiece, and articles made using the process. An improved ceramic-faced metal article is made by spraying fibers onto the workpiece by injecting fibers into the plasma stream external to a plasma gun nozzle. Then, plasma sprayed ceramic particles are caused to surround the fibers as a matrix. Optionally a removable polymer material is interposed on the workpiece surface after the fibers are sprayed but before the ceramic matrix is sprayed to provide a low stiffness connector between a low thermal expansion coefficient ceramic material and a high expansion coefficient metal substrate. The connector alleviates strains from thermal expansion differences.

U.S. Pat. No. 4,627,896 to Nazmy et al is directed to a method of applying a corrosion protection layer to the base of a gas turbine blade by embedding particles of SiC in a metallic matrix by means of powder, paste or electrolytic/electrophoretic methods and compacting, welding, or fusing and bonding the matrix-forming material to the base by means of hot pressing, hot isostatic pressing or laser beam, electron beam, or electric arc.

None of the patents described briefly above discloses a method of manufacturing metal and ceramic composite materials utilizing thermal spray techniques which may include the formation of in-situ alloys and wherein the method may employ multiple torches, and which is applicable to continuous fiber type reinforcement structures as well as to discrete reinforcement materials which may be sprayed, including an optional finishing step of diffusion annealing and/or hot isostatic pressing.

The current trend in the technology of warfare is toward smarter, faster, and more maneuverable tactical guided missiles. A faster, more maneuverable tactical missile results in a combination of increased loads and heating on body structures and aerodynamic surfaces. The heating problem becomes increasingly severe as the missile velocity increases beyond Mach 6. The combination of increased loads and heating exacerbates an already difficult design problem, since most structural materials demonstrate decreasing strength and stiffness with increasing temperature. For example, Rene 41 is a commonly used high-strength high-temperature nickel base superalloy. Its specific strength and specific modulus at room temperature are $60\times10^4$ inches and $1.1\times10^8$ inches, respectively. Values for these properties drop to $40\times10^4$ inches and $0.7\times10^8$ inches at 1500 degrees F. for specific strength and specific modulus, respectively, and sharply accelerate downward with increasingly higher temperatures. Current materials are also deficient in one or more of the following attributes: cost, reliability, availability, and fabricability. There is a need for new fabrication methods which will produce metal and ceramic composite materials having greater specific strength and specific modulus at high temperatures and which can be manufactured at reasonable cost. Such composites should be substantially free of matrix-reinforcement interaction and degradation.

SUMMARY OF THE INVENTION

In brief, the present invention involves a process for manufacturing metal and ceramic matrix composite materials. The invention also encompasses various composite products made by the disclosed method. The resulting composite material comprises a reinforcement material in either continuous or discrete form embedded in a matrix material which is either a pure metal, a metal alloy, or a ceramic or ceramic alloy. To reduce or prevent reaction between the matrix material and the reinforcement material, a barrier coating optionally can be applied to the reinforcement material prior to or during the composite fabrication process.

Although the described method is generally applicable to other metal and ceramic matrices utilizing other reinforcement phases, barrier coatings, and various matrix material feed techniques, for illustrative purposes the method is described in terms of fabricating a composite comprising a titanium matrix with continuous filament reinforcement materials. The method basically consists of using an electric arc or plasma arc to spray a thin layer of titanium or titanium alloy over a preplaced layer of reinforcement material. The reinforcement material comprises a unidirectional or bidirectional woven cloth as the strengthening/stiffening phase of the composite. Alternate metal-filament layers are built up until a desired object shape, thickness, and filament orientation are achieved.

Electric arc spraying is used for wire feeding, or plasma arc spraying for powder feeding, of titanium stock. A finishing step of a high-temperature diffusion anneal or hot isostatic pressing is desirable but not mandatory. The optional finishing step ensures that the resulting composite is homogeneous, well bonded, and free from the effects of internal voids. The finishing step is best accomplished with the composite in a "local" vacuum that is achieved by placing the composite inside an evacuated metal can or skin envelope. Since titanium is a reactive metal at elevated temperatures and could react with the reinforcing phase during the diffusion anneal or hot isostatic pressing step, if not in the spraying step, a diffusion barrier may optionally be required. This optional barrier is accomplished by coating the reinforcement material with a refractory metal such as Mo, W, or Ta or other relatively inert metals such as Co, Ni, Cu, Ag, Pd or Au or a stable oxide such as $Y_2O_3$, $Al_2O_3$ or $TiO_2$ or a common titanium alloying element such as Al. Application of a metallic coating to the filaments is best performed by vapor deposition or electrolytic plating methods. Oxide coatings are best applied by sputtering or plasma arc spraying. For a titanium matrix and graphite reinforcement, vapor-deposited aluminum is a preferred, but not the only suitable, barrier coating. The optimum thickness of the barrier coating will be a function of the diffusion or reaction rate, which in turn depends on the coating material and the time and temperature of exposure at the elevated temperature.

BRIEF DESCRIPTION OF THE DRAWING

A better understanding of the present invention may be realized from a consideration of the following detailed description, taken in conjunction with the accompanying drawing in which:

The sole FIGURE is a simplified schematic flow diagram of a process for fabricating metal and ceramic matrix composite materials.

DESCRIPTION OF THE PREFERRED EMBODIMENTS

In accordance with the present invention a process is provided for manufacturing metal and ceramic matrix composite materials which encompasses a wide variety of resulting composites. The accompanying drawing figure is a simplified flow diagram of the process of the present invention. As indicated in the FIGURE, the resulting composite material comprises a reinforcement material B in either continuous or discrete form embedded in a matrix material A which is either a pure metal, a metal alloy, or a ceramic. To reduce or prevent reaction between matrix material A and reinforcement material B, an optional step in the process comprises applying a barrier coating to the reinforcement material B.

Suitable reinforcement materials in continuous filament form include graphite, silicon carbide, alumina, boron carbide, and silicon nitride. The reinforcement material B can take the form of a woven fabric. If the matrix material is a metal which is reactive at elevated temperatures and would react with the reinforcing phase to form a weak or brittle compound during the process, a diffusion barrier must be provided. This is best accomplished by coating the reinforcement material with a refractory metal, a relatively inert metal or alloy, a stable oxide, or an element that commonly alloys with the matrix material. Possible refractory metals include the following elements and their alloys: V, Cr, Zr, Nb, Mo, Rh, Hf, Ta, W, Re, Os, Th, and Ir. The precious metals Pd, Ag, Au, and Pt, as well as Co, Ni, Cu, Sn, and Al, are also possible candidates for a barrier coating material. Stable oxides include titanium oxide, aluminum oxide and Yttrium oxide.

The application of a metallic barrier coating to a filament-type reinforcement material is best performed by vapor deposition or electrolytic plating methods. In the case of oxide barrier coatings, the best methods are sputtering or plasma arc spraying. An optimum thickness of barrier coating is a function of the diffusion or reaction rate which in turn depends on the coating material as well as the anticipated time and temperature of exposure during the manufacturing process. A desirable barrier material is one which at least wets both reinforcement and matrix materials. The ideal situation is one in which there is intimate contact between the matrix and reinforcement materials but not formation of a compound that would give rise to a zone of brittleness or weakness.

Alternatively, the reinforcement material B can take the form of discontinuous segments such as short fibers, small particles, and the like. Applying a barrier coating in the case of discrete particle reinforcement may be accomplished using a fluidized bed process or by dipping into molten metal.

The initial step in the composite fabrication process is to form a thin layer of composite material by arc spraying reinforcement material B, or barrier-coated reinforcement material B, with matrix material A. The fabrication process then basically consists of building up successive thicknesses of matrix-sprayed reinforcement layers. If the reinforcement material comprises a unidirectional or bidirectional woven cloth as the strengthening/stiffening phase of the composite, the orientation of successive layers of the fabric can be varied to give a more nearly isotropic strength and/or stiffness to the resulting composite. Thus, for example, if successive layers are oriented at 90 degrees with respect to each other, the resulting composite will be equally strong/stiff in four directions equally spaced from each other. If successive layers are oriented 60 degrees apart, the composite will be equally strong/stiff in six different directions equally spaced from each other. A successive difference of 45 degrees in angular orientation results in a composite which is equally strong/stiff in eight different directions, and so on.

There is a wide variety of materials which can be used as the matrix material. Suitable metallic matrix materials include aluminum, titanium, nickel, niobium, and their alloys. The matrix material can be applied in either wire or powder form. Suitable ceramic materials in the form of fine powder can be chosen from the group consisting of alumina, silicon carbide, boron carbide, and silicon nitride. Metallic matrix materials can be applied in wire form as either pure metals and/or prealloyed metals. If the metallic matrix material is in the form of powder, the powder can be a pure metal, an alloy, or a mixture of pure metal powders.

Thermal spraying techniques are known in the art of welding and brazing. A description of various techniques can be found in Volume 6 entitled "Welding, Brazing, and Soldering" of the *Metals Handbook*, Ninth Edition, American Society for Metals, Metals Park, Ohio 44073, published in 1983. In particular the articles on gas metal-arc welding (MIG welding), plasma arc welding, and hard facing by arc welding will be found informative in relation to the present application.

For matrix materials comprising powdered metals and ceramics, plasma arc spraying is the preferred technique. Plasma arc spraying is an arc process in which heat is produced by a constricted arc between a non-consumable tungsten electrode and a workpiece (transferred arc) or between a non-consumable tungsten electrode and a constricting orifice (non-transferred arc). When an arc is established through a gaseous column separating two electrodes, some of the gas becomes ionized into a plasma which consists of free electrons, positive ions, and neutral atoms. This current-conducting plasma part of the arc is maintained hot by the resistance heating effect of the current passing through it. Thermal ionization, which takes place in a high-temperature atmosphere, is the result of collisions of molecules and electrons in the gas and from radiation. Plasma arc welding is closely akin to gas tungsten-arc welding. Plasma is present in all arcs, and if a constriction containing an orifice is placed around the arc, the amount of plasma is greatly increased, resulting in a higher arc temperature, a more concentrated heat pattern, and higher arc voltage than can be obtained with a non-constrictive arc. In plasma arc welding two separate streams of gas are supplied to the torch. One stream surrounds the electrode within the orifice body and passes through the orifice, constricting the arc to produce a jet of very hot and fast moving plasma. This gas must be inert and is usually argon. The other stream of gas, the shielding gas, passes between the orifice body and the outer shield cup; it prevents the molten weld metal and the arc from being contaminated by the surrounding atmosphere. An inert gas or a non-oxidizing gas mixture can be used for shielding.

If the matrix material is a metal in wire form, gas metal-arc (MIG) spraying techniques are suitable. Gas metal-arc welding (often called MIG welding) is an arc welding process in which the heat is generated by an arc between a consumable electrode and the work metal. The electrode is a bare solid wire that is continuously fed to the weld area, becoming the filler material as it is consumed. The welding area is protected from atmospheric contamination by a gaseous shield provided by a stream of gas or mixture of gases fed through the electrode holder. In a spray arc, the metal is transferred from the end of the electrode wire in an axial stream of fine droplets. These small droplets come from the tapered end of the electrode. One droplet follows another but they are not connected. The spray-arc mode of transfer gives high heat input, maximum penetration, and a high deposition rate.

If the reinforcement phase comprises discrete particles, the discrete particles can be introduced in the composite fabrication process by feeding the particles in the same torch as the matrix material powder or from a second, independent torch. The initial layer of composite material is fabricated by establishing the initial layer of discrete-particle reinforcement on some sort of form. The surface on which the discrete particles are placed should be one to which they will not subsequently stick. Alternatively, a separating compound can be applied to the surface on which the discrete particles are placed initially.

Fabrication of alloy matrices is readily accomplished by arc spraying. The desired alloy composition may be readily achieved by one of the following methods: in the form of powder either premixed in elemental form or independently fed to the same torch as prealloyed powder or as alloy powder from a second torch, or in the form of the desired alloy composition wire or as elemental or alloy wire from a second torch. When large alloy additions to the base metal are required, say greater than ten weight percent, the use of multiple independently controlled torches may be convenient. Each torch can be independently fed wire or powder as desired. It is preferable that the composite surface "aim point" for the multiple torches be identical, but this is not mandatory. The identical aim point gives greater assurance of intimate, uniform mixing of the components. The use of multiple torches is also economical because of the proportionately larger volume of material that can be applied per unit time. The economic benefits of multiple torches can be extended to volume production by using multiple sets of torches in tandem, or parallel, to fabricate large-area parts, or by utilizing multiple sets of torches to simultaneously fabricate multiples of small- and medium-area parts.

By appropriate torch and/or workpiece movement and control, associated tooling, and matching reinforcement layer shape, almost any solid part of regular or irregular shape can be fabricated. It is possible by the judicious use of permanent or removable cores to build parts with intentional internal void shapes. When separate torches or multiple feeds to a single torch are used to introduce a pure metal and an alloy, it is also possible to vary the composition of the deposited alloy to obtain tailored properties in specified locations of the part. For example, one alloy composition may be utilized for the "inside" of the part and another alloy utilized to form the "surface" of the part to provide enhanced corrosion, wear, lubrication, oxidation, etc. characteristics to the surface. Obviously the "surface" and "inside" alloys must be compatible with each other.

For metals which react with air at elevated temperatures, the deposited surface should be deposited below the reaction temperature, protected by trailing inert helium or argon gas shields, or fabricated in an inert-gas (helium or argon) or vacuum chamber. If a vacuum chamber is used, it must of course be constantly pumped.

As indicated in the drawing figure, the fabrication process of the present invention includes an optional final step of subjecting the composite product formed by previous steps to a high-temperature diffusion annealing or to a hot isostatic pressing. The purpose of this optional finishing step is to ensure that the resulting composite is homogeneous, well bonded, and free from the effects of internal voids. An isostatic hot pressing method is described in Ceramic Bulletin, Vol. 54, No. 2 (1975) in an article by K. H. Hardtl entitled "Gas Isostatic Hot Pressing Without Molds." Isostatic hot pressing uses a gas, usually inert, to densify an object having "closed porosity" through a high isostatic gas pressure. As compared with hot pressing processes previously used, isostatic hot pressing appears to be suitable for mass production since no mold is used and the hot pressing of bodies of arbitrary shape is possible. There are no problems connected with contact between the body being pressed and a mold or die. To minimize voids and porosity, the composite body can be isostatically hot pressed in an evacuated thin metal can or skin envelope.

In the case of metal matrices, the optional hot isostatic pressing step in the fabrication process must be tailored to the individual metal. For aluminum and its alloys, a temperature range of 900 degrees F. to 1200 degrees F. is suitable, with one to four hours being a reasonable range of pressing times. Titanium or nickel and their alloys can be hot pressed for one-quarter to four hours in the temperature range of 1700 degrees F. to 2000 degrees F. The metal niobium and its alloys are preferably pressed for one-quarter to four hours at a temperature in the range from 2000 degrees F. to 2400 degrees F.

Composite materials with ceramic matrices require somewhat higher pressing temperatures. For alumina, one hour of pressing at a temperature in the range 2800 degrees F. to 3200 degrees F. is recommended. The ceramic silicon carbide can be suitably hot pressed at a temperature in the range from 3000 degrees F. to 3400 degrees F. for a time of one hour. Boron carbide requires a temperature in the range from 3800 degrees F. to 4200 degrees F. and should be pressed for a time ranging from one to four hours. Suitable pressures for hot isostatic pressing are in the range from 10,000 to 20,000 psi. An operating gas atmosphere of helium, argon, or other non-reactive gas should be used.

As an example of a particularly attractive composition material, the case of titanium matrix composites will be briefly considered. For these matrices and a reinforcement material from the group consisting of graphite, SiC, $Al_2O_3$, $B_4C$, and $Si_3N_4$, the metal aluminum is suitable as a barrier coating material. Aluminum is a common titanium alloying element. The application of the metallic barrier coating to the reinforcement material, say woven filament fabric, is preferably carried out by vapor deposition methods or by arc spraying. The optimum thickness of the barrier coating will depend on the anticipated time and temperature of exposure of elevated temperatures of the titanium-matrix composite material.

Although there have been shown and described hereinabove specific arrangements of a process for manufacturing metal and ceramic matrix composite materials and the products thereof in accordance with the invention for the purpose of illustrating the manner in which the invention may be used to advantage, it will be appreciated that the invention is not limited thereto. For example, besides the particular metal matrix composites which have been discussed above, others can also be fabricated by the same general process. Other metals include common structural metals and their alloys: Mg, Al, Fe, Co, Ni, Cu, Zn, Sn, and Pb; refractory metals and alloys of V, Cr, Zr, Nb, Mo, Rh, Hf, Ta, W, Re, Os, Th, and Ir; and the precious metals Pd, Ag, Au, and Pt. Particulate and continuous filament reinforcement materials could typically include B, $B_4C$, SiC, $Si_3N_4$, BN, C, $Al_2O_3$, and $SiO_2$ as well as high-strength wire such as CRES 301, Mo, Ta, and W. Attractive ceramic matrices may include, but are not limited to, $Al_2O_3$, $B_4C$, $SiO_2$, SiC, $Si_3N_4$, BN, and AlN. Accordingly, any and all modifications, variations, or equivalent arrangements which may occur to those skilled in the art should be considered to be within the scope of the invention as defined in the annexed claims.

What is claimed is:

1. A process for manufacturing metal and ceramic matrix composites comprising the steps of:

a) arc spraying a thin layer of at least one matrix material over a preplaced first layer of a woven fabric reinforcement material;

b) placing an additional layer of woven fabric reinforcement material on a sprayed matrix layer resulting from the previous step;

c) arc spraying a thin layer of said at least one matrix material over said additional layer; and d) repeating steps b) and c) until a desired object shape and thickness are achieved;

wherein said reinforcement material comprises discontinuous segments of a material from the group consisting of graphite, silicon carbide, alumina, and boron carbide; and wherein each said reinforcement layer further comprises a plurality of discrete particles which have been coated by a fluidized bed process with a barrier material that does not form a brittle compound with said matrix material.

2. The process of claim 1 further comprising a finishing step to ensure that said composite is homogenous, well bonded, and substantially free of internal voids.

3. The process of claim 2 wherein said finishing step consists of a high-temperature diffusion anneal.

4. The process of claim 1 wherein each of the arc spraying steps a) and c) comprises spraying a plurality of thin layers of said at least one matrix material over the previously deposited thin layer.

5. The process of claim 1 wherein said matrix material comprises one or more metals from the group consisting of aluminum, titanium, nickel, niobium and their alloys.

6. The process of claim 5 wherein said metal is in the form of wire.

7. The process of claim 6 wherein said metal wire is applied as a pre-alloyed mixture of metals from the group consisting of aluminum, titanium, nickel, and niobium.

8. The process of claim 5 wherein said metal is in the form of powder.

9. The of claim wherein 8 wherein said metal powder comprises a pre-alloyed mixture of metals from the group consisting of aluminum, titanium, nickel, and niobium.

10. The process of claim 8 wherein said metal powder comprises a mixture of powdered metals from the group consisting of aluminum, titanium, nickel, and niobium.

11. The process of claim 1 wherein each said layer of reinforcement material is first coated with a barrier material which does not form a brittle compound with said matrix material.

12. The process of claim 11 wherein said barrier material comprises a refractory metal from the group consisting of V, Cr, Zr, Nb, Mo, Rh, Hf, Ta, W, Re, Os, Th, and Ir.

13. The process of claim 11 wherein said barrier material comprises a metal from the group consisting of Co, Ni, Cu, and Sn.

14. The process of claim 11 wherein said barrier material comprises aluminum.

15. A process for manufacturing metal and ceramic matrix composites comprising the steps of:

a) arc spraying a thin layer of at least one matrix material over a preplaced first layer of a woven fabric reinforcement material;

b) placing an additional layer of woven fabric reinforcement material on a sprayed matrix layer resulting from the previous step;

c) arc spraying a thin layer of said at least one matrix material over said additional layer; and d) repeating steps b) and c) until a desired object shape and thickness are achieved;

wherein said reinforcement material comprises discontinuous segments of a material from the group consisting of graphite, silicon carbide, alumina, and boron carbide; and wherein each said reinforcement layer further comprises a plurality of discrete particles which have been coated by dipping into molten metal that does not form a brittle compound with said matrix material.

16. A process for fabricating metal and ceramic composites comprising the steps of:

a) establishing a first layer of a segmented woven fabric reinforcement material on a form to which said reinforcement material does not adhere;

b) arc spraying a matrix material onto said first layer to form a composite layer;

c) applying more of said segmented woven fabric reinforcement material to said composite layer to form a resulting reinforcement layer;

d) arc spraying more of said matrix material onto said resulting layer of the previous step to form an additional composite layer; and e) repeating steps c) and d) ad libitum until a desired thickness and form are achieved;

wherein each said reinforcement layer further comprises a plurality of discrete particles which have been coated by a fluidized bed process with a barrier material that does not form a brittle compound with said matrix material.

17. The process of claim 16 further comprising a finishing step of high-temperature diffusion annealing.

18. The process of claim 16 wherein in steps a) and c) said segmented reinforcement material is applied by arc spraying.

19. The process of claim 16 wherein steps c) and d) are performed simultaneously by arc spraying using a torch fed by both said segmented reinforcement material and said matrix material.

20. The process of claim 16 wherein steps c) and d) are performed simultaneously by arc spraying with separate torches for said segmented reinforcement material and said matrix material.

21. The process of claim 16 wherein said matrix material comprises one or more metals from the group consisting of aluminum, titanium, nickel, and their alloys.

22. The process of claim 16 wherein said segmented reinforcement material comprises ceramic material selected from the group consisting of alumina, silicon carbide, boron carbide, and silicon nitride.

23. The process of claim 22 wherein said segmented reinforcement material comprises short fibers.

24. The process of claim 16 wherein said segmented reinforcement material is first coated with a barrier material which does not form a brittle compound with said matrix material.

25. The process of claim 24 wherein said barrier material comprises a refractory metal from the group consisting of V, Cr, Zr, Nb, Mo, Rh, Hf, Ta, W, Re, Os, Th, and Ir.

26. The process of claim 24 wherein said barrier material comprises a metal from the group consisting of Co, Ni, Cu, Sn and Al.

27. The process of claim 24 wherein said barrier material comprises an insert metal selected from the group consisting of Ag, Au, Pd and Pt.

28. A process for fabricating metal and ceramic composites comprising the steps of:

a) establishing a first layer of a segmented woven fabric reinforcement material on a form to which said reinforcement material does not adhere;

b) arc spraying a matrix material onto said first layer to form a composite layer;

c) applying more of said segmented woven fabric reinforcement material to said composite layer to form a resulting reinforcement layer;

d) arc spraying more of said matrix material onto said resulting layer of the previous step to form an additional composite layer; and a) repeating steps c) and d) ad libitum until a desired thickness and form are achieved;

wherein each said reinforcement layer further comprises a plurality of discrete particles which have been coated by dipping into molten metal that does not form a brittle compound with said matrix material.

* * * * *